US011006728B2

(12) United States Patent
De Gaetani

(10) Patent No.: US 11,006,728 B2
(45) Date of Patent: May 18, 2021

(54) COSMETIC CONTAINER FOR APPLYING A LIP BALM

(71) Applicant: INTERCOS S.p.A., Milan (IT)

(72) Inventor: Maria De Gaetani, Agrate Brianza (IT)

(73) Assignee: INTERCOS S.P.A., Milan (IT)

( * ) Notice: Subject to any disclaimer, the term of this patent is extended or adjusted under 35 U.S.C. 154(b) by 111 days.

(21) Appl. No.: 16/462,758

(22) PCT Filed: Nov. 20, 2017

(86) PCT No.: PCT/EP2017/079813
§ 371 (c)(1),
(2) Date: May 21, 2019

(87) PCT Pub. No.: WO2018/095871
PCT Pub. Date: May 31, 2018

(65) Prior Publication Data

US 2019/0374006 A1 Dec. 12, 2019

(30) Foreign Application Priority Data

Nov. 23, 2016 (IT) ..... 102016000118774

(51) Int. Cl.
*A45D 40/00* (2006.01)
*A45D 40/08* (2006.01)

(52) U.S. Cl.
CPC ..... *A45D 40/00* (2013.01); *A45D 40/08* (2013.01); *A45D 2040/0062* (2013.01); *A45D 2200/05* (2013.01)

(58) Field of Classification Search
CPC ..... A45D 40/00; A45D 40/0068; A45D 40/0081; A45D 40/0087; A45D 40/08; A45D 40/16; A45D 2040/0062; A45D 2040/0025; A45D 2200/005; A45D 40/20; A45D 2040/0012
USPC ..... 401/88, 49, 98
See application file for complete search history.

(56) References Cited

U.S. PATENT DOCUMENTS

| | | | | |
|---|---|---|---|---|
| 8,651,308 | B1 | 2/2014 | Sung | |
| 10,039,366 | B1 * | 8/2018 | Facer | A45D 40/24 |
| 10,542,814 | B2 * | 1/2020 | Kelders | A45D 40/16 |

(Continued)

FOREIGN PATENT DOCUMENTS

| | | |
|---|---|---|
| GB | 2 162 822 | 2/1986 |
| WO | 2011/071792 | 6/2011 |
| WO | 2016/164527 | 10/2016 |

OTHER PUBLICATIONS

International Search Report and Written Opinion of the International Searching Authority in International (PCT) Application No. PCT/EP2017/079813 dated Jan. 5, 2018.

*Primary Examiner* — David J Walczak
(74) *Attorney, Agent, or Firm* — Wenderoth, Lind & Ponack, L.L.P.

(57) ABSTRACT

A cosmetic container (1) for applying a lip balm (2). The cosmetic container includes a cap (14), an upper inner shell (19, 149) and a base (16). The base has a lower inner shell (3), a bottom through opening (23), a one piece support frame (30) for supporting the balm. The support frame includes a central hollow hub (36) having a multiplicity of radial through slits (500), and a multiplicity of radial walls (34) partitioning the inside of the lower inner shell (3) into sectors of space (18).

12 Claims, 7 Drawing Sheets

(56) References Cited

U.S. PATENT DOCUMENTS

| | | | | |
|---|---|---|---|---|
| 10,582,754 | B2 * | 3/2020 | Delia | A45D 40/00 |
| 2018/0296460 | A1 * | 10/2018 | Wong | A61K 8/88 |

* cited by examiner

COSMETIC CONTAINER FOR APPLYING A LIP BALM

BACKGROUND OF THE INVENTION

1. Technical Field

The present invention relates to a cosmetic container for applying a lip balm.

2. Description of the Related Art

In the prior art, U.S. Pat. No. 8,651,308 describes a cosmetic container for applying a lip balm comprising a top and a base separably mounting a support ring for the balm in solidified phase. The support ring comprises a skeleton-shaped support frame comprising a multiplicity of through openings to allow the passage of the balm in heated semi-fluid phase during a filling step of the container. The support frame of the support ring supports the balm in solidified phase. The base comprises a lower opening to allow access from below of a filling tube for the balm in heated semi-fluid phase. Disadvantageously, to avoid damaging the cosmetic container and prevent the contamination of the balm, the filling tube is inserted deep into the cosmetic container with respect to the lower opening so as to avoid the balm in heated semi-fluid phase to spill and to prevent overfilling of the balm in heated semi-fluid phase, events which would damage the cosmetic container and cause contamination of the balm.

To avoid damaging the cosmetic container with the balm in heated semi-fluid phase and to prevent contamination of the balm, WO 2011/071792 A2 and EP 2509461 A2 describe another cosmetic container for applying a lip balm comprising a support ring separably mountable with a base of the container, as the patent described above. During the filling step of the balm in heated semi-fluid phase, the base is separated from the support ring and the balm in heated semi-fluid phase is allowed to pass directly from the through openings of the support ring to allow filling the balm in heated semi-fluid phase into the cosmetic container. Disadvantageously, the filling of the balm in heated semi-fluid phase into the cosmetic container is complicated and requires the base of the cosmetic container to be mounted at a later time, slowing down the mounting times and complicating the mounting of the cosmetic container.

GB 2162822 A, which is the closest prior art, discloses a cosmetic container for applying a lip balm, which comprises a cap and a base comprising a central hollow hub with a plurality of passing-through slits for allowing passage of the balm in heated semifluid phase during the filling step between an inner cavity of the central hollow hub and an upper inner shell. Disadvantageously, the balm becomes cloudy and does not enter in controlled form the upper inner shell and the slow flow does not allow the homogeneity of the balm, which solidifies in non-homogeneous clots.

SUMMARY OF THE INVENTION

It is an object of the present invention to obtain a more simplified cosmetic container for applying a lip balm, much easier and quicker to mount, which allows for being filled with balm in heated semi-fluid phase without being damaged and without contaminating the balm.

In accordance with the invention, such an object is achieved by means of a cosmetic container defined in the appended claims.

BRIEF DESCRIPTION OF THE DRAWINGS

The features of the present invention will become apparent from the following detailed description of a practical embodiment thereof, shown for non-limiting purposes, in the accompanying drawings, in which.

DETAILED DESCRIPTION OF THE INVENTION

Figure 1:
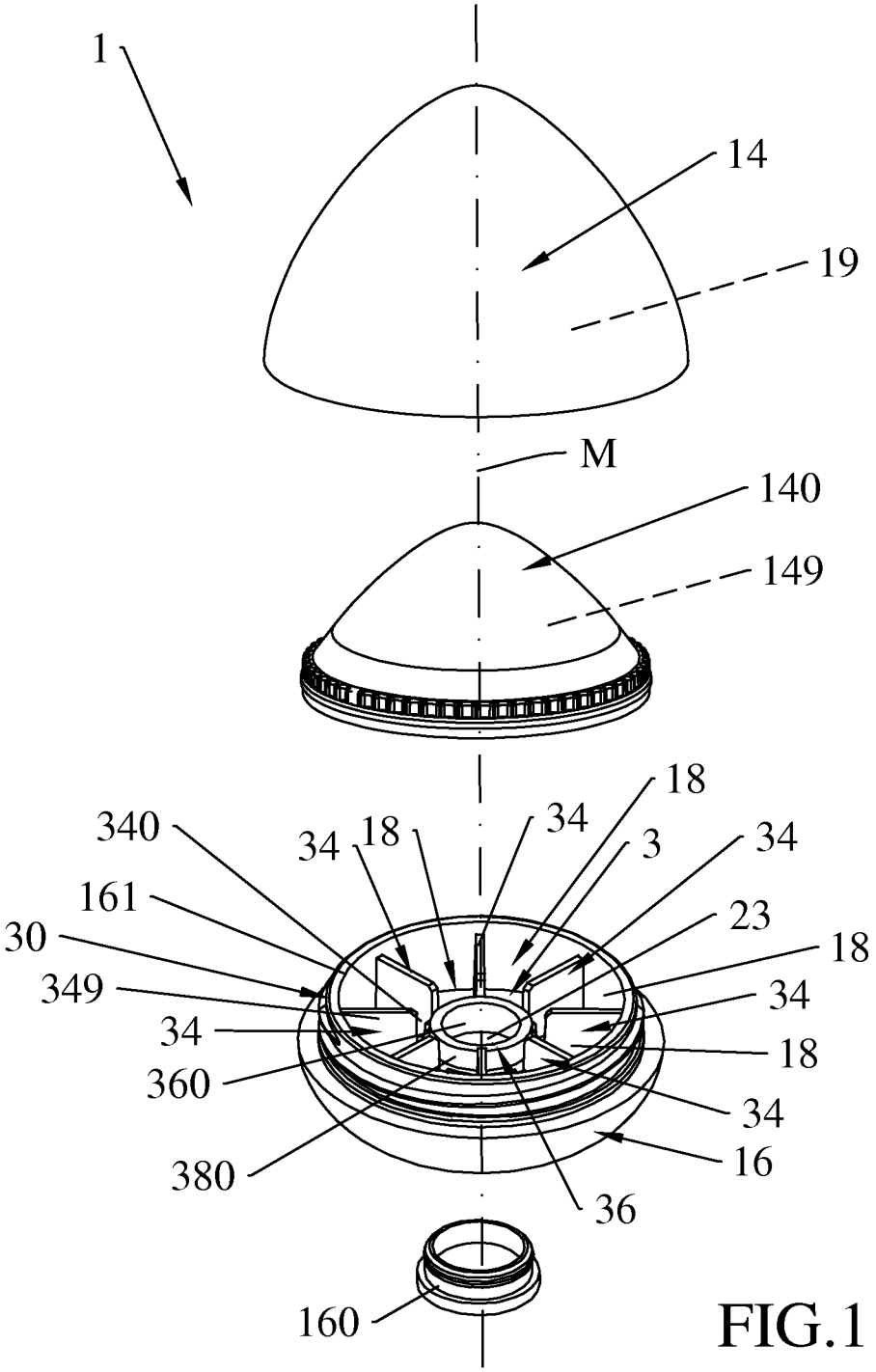
FIG. 1 shows an exploded perspective view of a cosmetic container for applying a lip balm according to the present invention.

With reference to the figures listed above, a cosmetic container 1 for applying a lip balm 2 should be noticed, comprising a cap 14, an upper inner shell 149 and a base 16.

Figure 2:
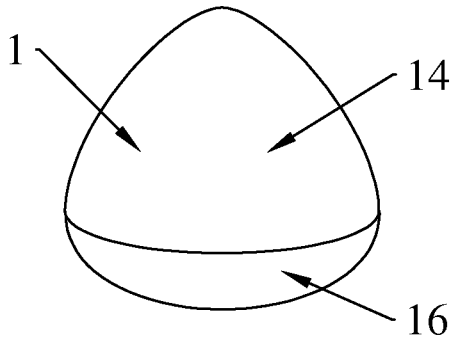
FIG. 2 shows a perspective view of the closed cosmetic container.
Figure 3:
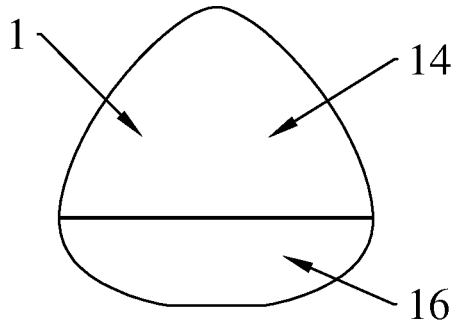
FIG. 3 shows a side view of the closed cosmetic container.
Figure 4:
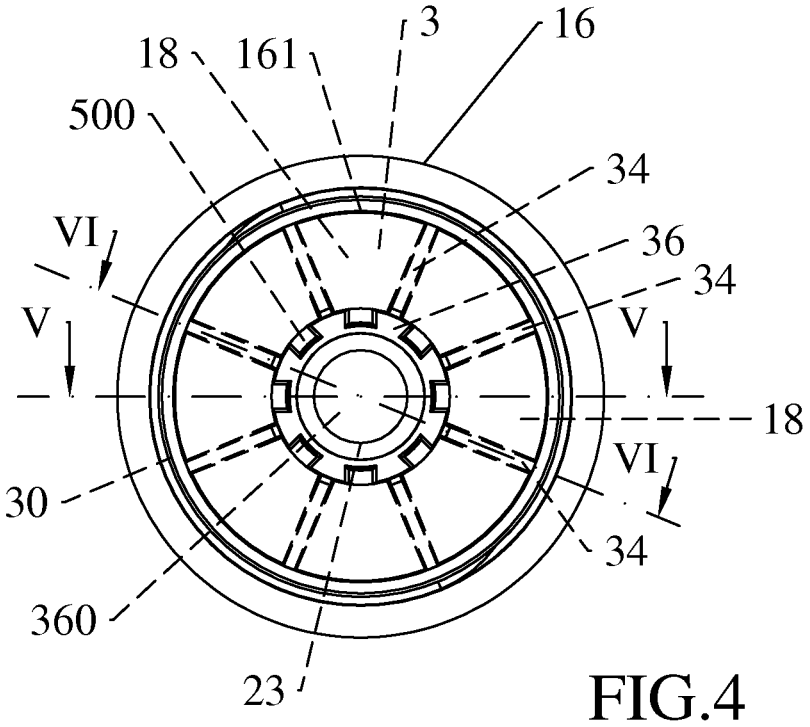
FIG. 4 shows a top view of the closed cosmetic container.
Figure 5:
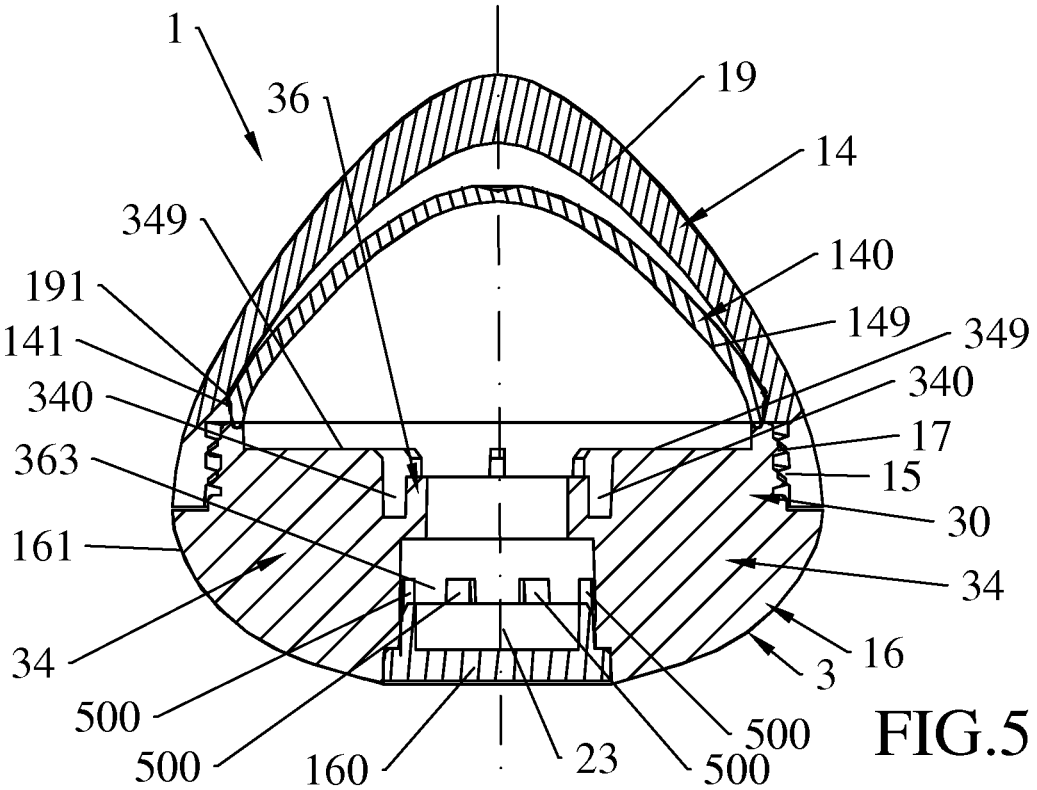
FIG. 5 shows a sectional view along the line V-V of FIG. 4.
Figure 6:
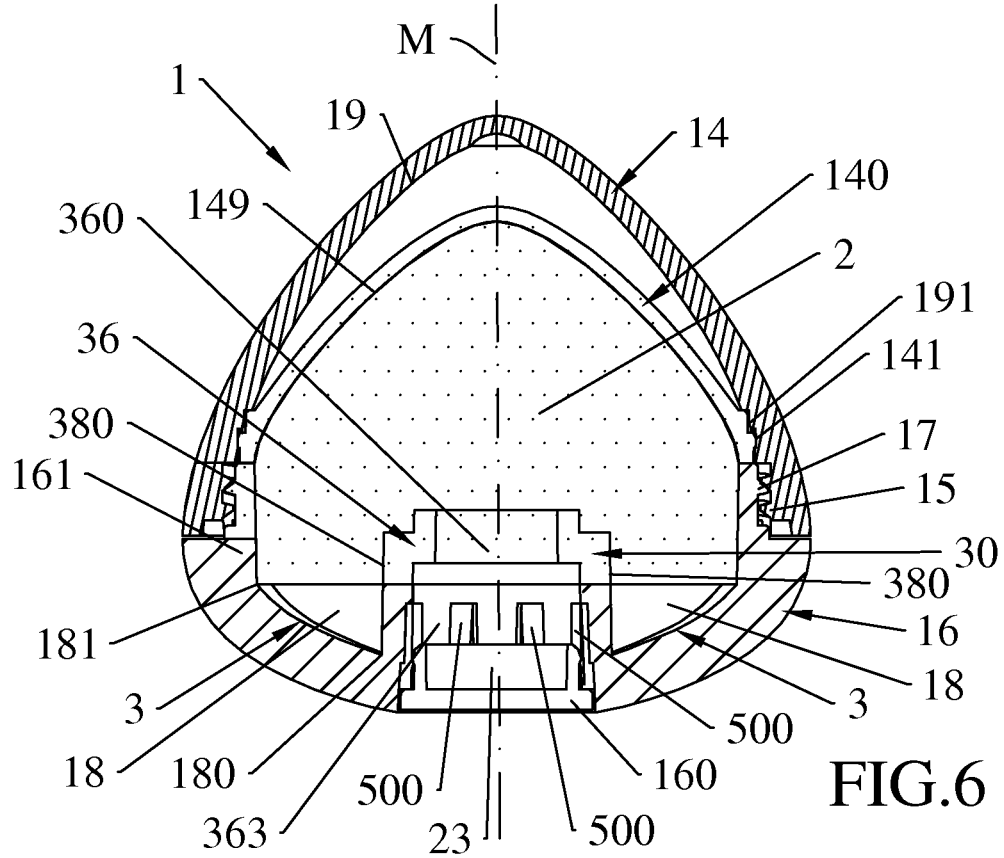
FIG. 6 shows a sectional view along the line VI-VI of FIG. 4.
Figure 7:
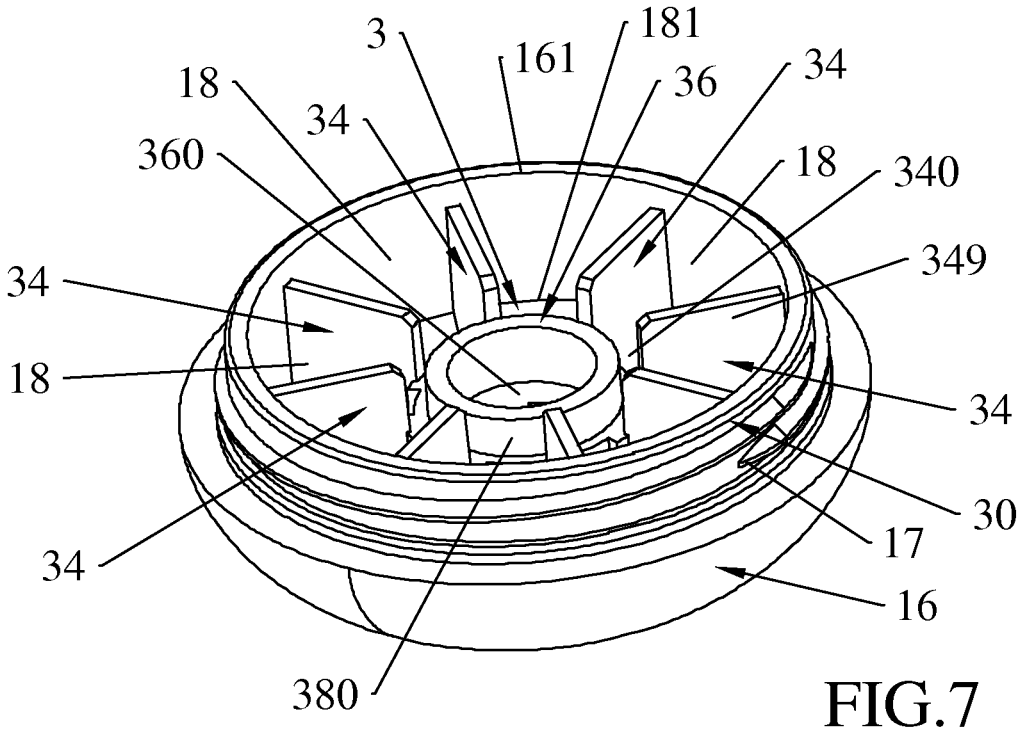
FIG. 7 shows a top perspective view of a base of the cosmetic container.
Figure 8:
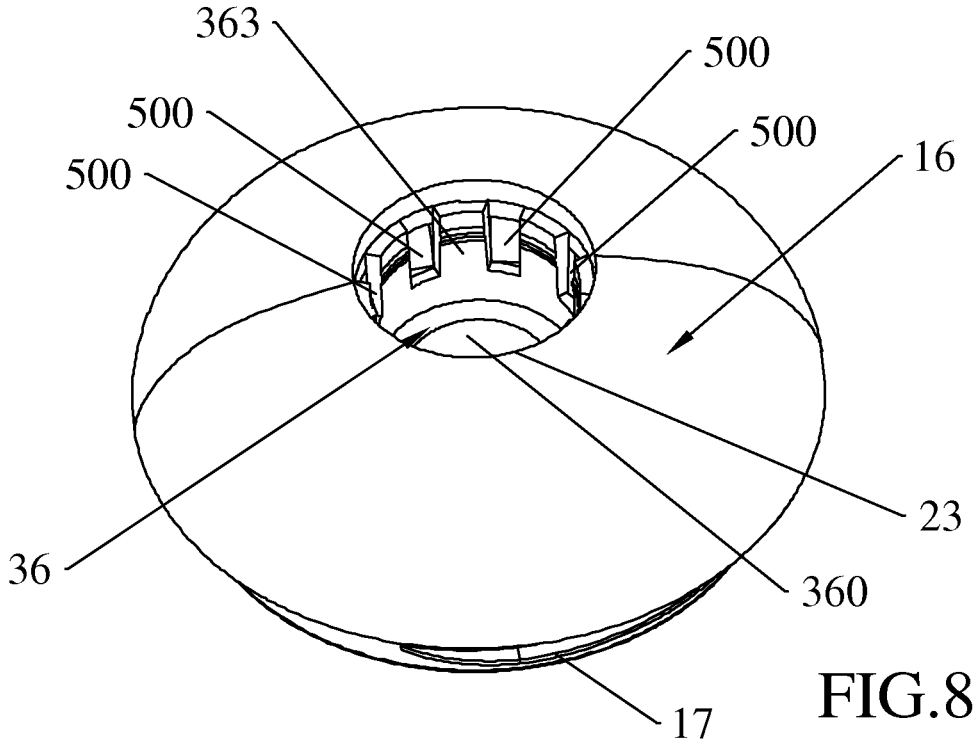
FIG. 8 shows a bottom perspective view of a base of the cosmetic container.
Figure 9:
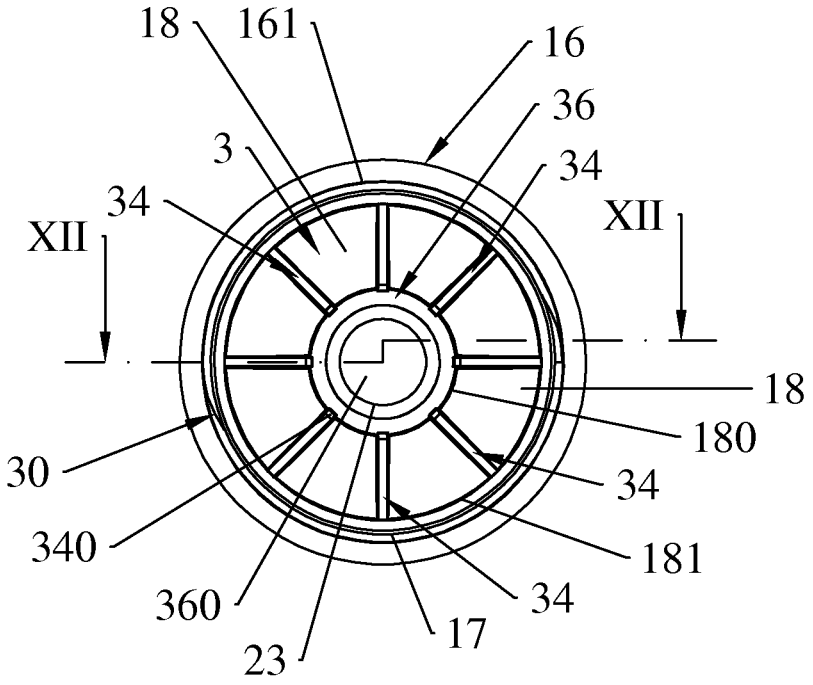
FIG. 9 shows a top view of the base of the cosmetic container.
Figure 10:
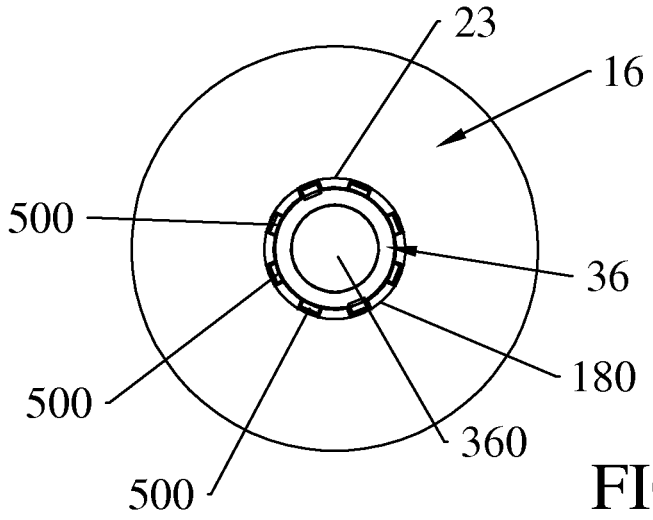
FIG. 10 shows a bottom view of the base of the cosmetic container.
Figure 11:
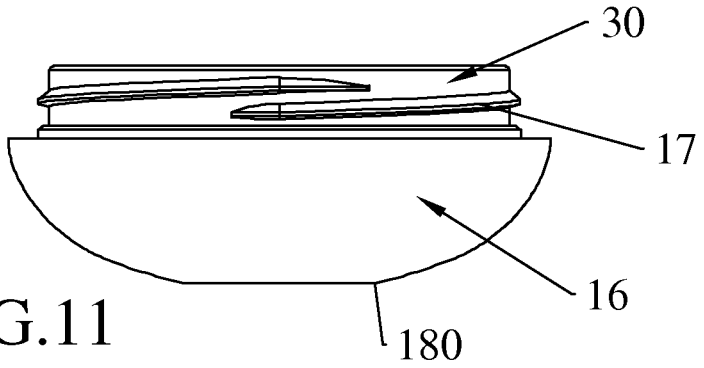
FIG. 11 shows a side view of the base of the cosmetic container.
Figure 12:
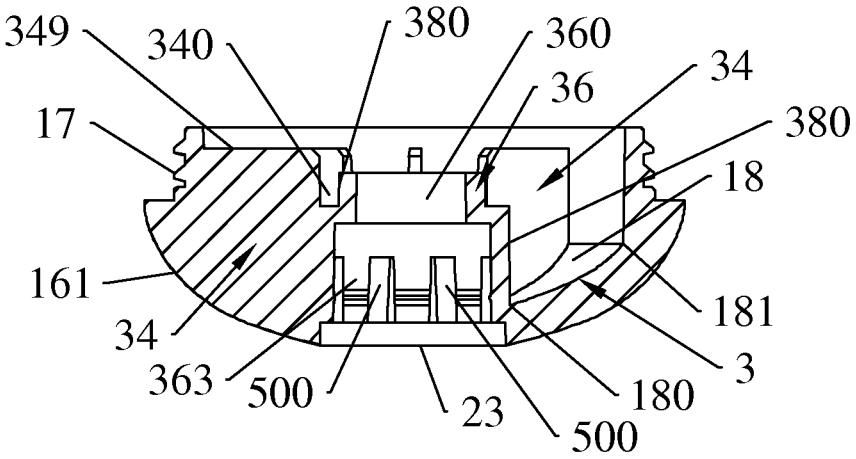
FIG. 12 shows a section along line XII-XII of FIG. 9.

The cap 14 and the base 16 are separably mountable to each other along a mounting axis M to form the cosmetic container 1, as shown in FIGS. 1 and 2.

As shown in particular in FIGS. 1-6, and 13, the cap 14 is of curvilinear shape.

As shown in particular in FIGS. 1-3, 5-6, and 14-16, the cosmetic container 1 comprises a central cap 140 including an upper inner shell 149. The central cap 140 is separably mountable with the cap 14 along the mounting axis M.

The central cap 140 is of curvilinear shape.

The upper inner shell 149 is provided between the cap 14 and the base 16, and the upper inner shell 149 has a complementary shape with respect to an outer surface of the lip balm 2 in solidified phase. The outer surface of the balm 2 is of curvilinear shape adapted to apply the balm 2 on the lips.

Advantageously, the upper inner shell 149 is mounted to the base 16 during the filling step, thus facilitating the mounting operations and simplifying the cosmetic container 1. The upper inner shell 149 and the base 16 contain the balm 2 in a heated semi-fluid phase during the filling step.

The upper inner shell 149 is of curvilinear shape.

Advantageously, the central cap 140 allows the outer cap 14 to have any shape in a simpler manner, since the external shape of the central cap 140 may follow the shape of the upper inner shell 149, while the outer cap 14 may have any shape.

Figure 13:
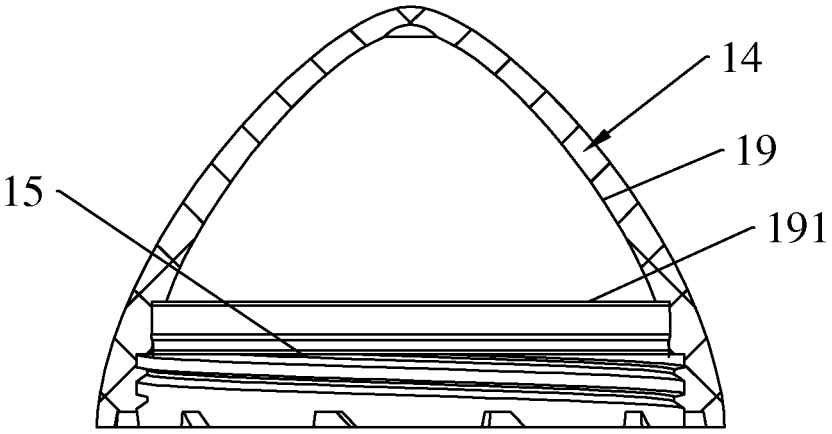
FIG. 13 shows a sectional view of a cap of the cosmetic container along line V-V of FIG. 4.

As shown in particular in FIG. 13, the cap 14 comprises an inner threaded portion 15.

As shown in particular in FIGS. 1, 7, 11 and 12, the base 16 comprises an outer threaded portion 17. The inner threaded portion 15 of the cap 14 screws on the outer threaded portion 17 of the base 16.

Figure 16:
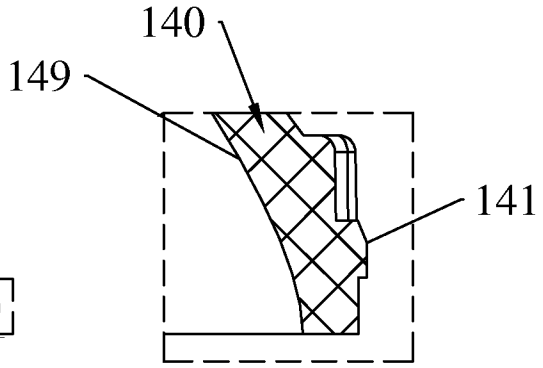
FIG. 16 shows an enlarged detail of FIG. 15.
Figure 15:
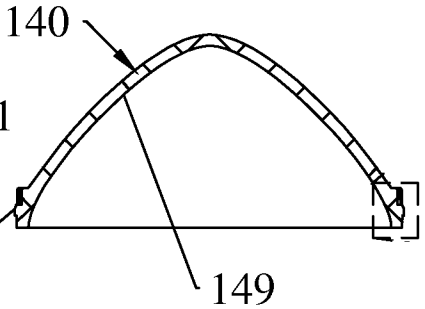
FIG. 15 shows a sectional view of the central cap along line V-V of FIG. 4.
Figure 14:
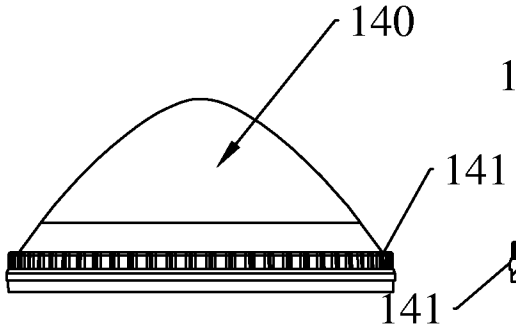
FIG. 14 shows a side view of a central cap of the cosmetic container.
Figure 18:
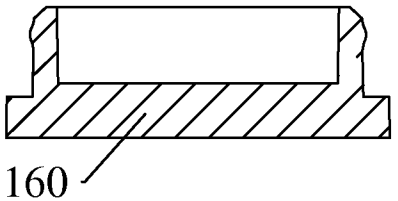
FIG. 18 shows a section of the lower plug along line V-V of FIG. 4.
Figure 17:
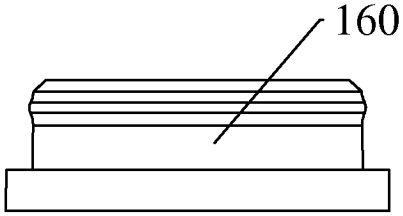
FIG. 17 shows a lower plug of the cosmetic container.

As shown in particular in FIGS. 1, 15 and 16, the central cap 140 includes interlocking elements 141, which interlock with interlocking elements 191 of an inner surface of the cap 14. As shown, in particular in FIG. 13, the interlocking elements 191 of the inner surface of the cap 14 have a complementary shape with respect to the interlocking elements 141 of the central cap 140.

Advantageously, when unscrewing the cap 14 from the base 16 to open the cosmetic container 1 to apply the lip balm 2, the central cap 140 is mounted on the cap 14 and, therefore, it is sufficient to only unscrew the cap 14 to open the cosmetic container 1 and apply the balm 2 on the lips.

As shown in particular in FIGS. 5-12, the base 16 comprises a support frame 30 to support the lip balm 2 in solidified phase.

The support frame 30 is advantageously in one piece with the base 16 to simplify the mounting of the cosmetic container 1, and making the mounting operations of the cosmetic container 1 quicker and safer.

The support frame 30 of the base 16 supports the lip balm 2 in solidified phase.

The base 16 comprises a lower inner shell 3.

The lower inner shell 3 comprises a border 181 in contact with an outer wall 161 of the base 16 and the inner central portion 180, which is the bottom of the lower inner shell 3. The border 181 of the lower inner shell 3 is arranged at a higher level with respect to the inner central portion 180 of the lower inner shell 3. The level is measured along the mounting axis M.

The lower inner shell 3 is of concave shape to even further simplify the cosmetic container 1.

At the bottom of the base 16, a through opening 23 is provided, and is adapted to allow the passage of balm 2 in heated semi-fluid phase during a filling step of the balm 2 in heated semi-fluid phase into the cosmetic container 1.

An inner central portion 180 of the lower inner shell 3 is the inner bottom of the base 16 and opens in the through opening 23. The through opening 23 opens the inside of the cosmetic container 1 outwards.

As shown in particular in FIGS. 4-12, the support frame 30 of the base 16 comprises a central hollow hub 36 extending along the mounting axis M of the inner central portion 180 of the lower inner shell 3 of the base 16 toward the upper inner shell 149.

The central hollow hub 36 comprises an inner cavity 360 opening at the bottom in the through opening 23. The central hollow hub 36 comprises an outer surface 380 facing toward the lower inner shell 3 of the base 16.

The support frame 30 of the base 16 comprises a multiplicity of radial walls 34 partitioning the inside of the lower inner shell 3 into sectors of space 18 of the lower inner shell 3. Each radial wall 34 of the multiplicity of radial walls 34 extends in two directions. Each radial wall 34 extends radially from the outer surface 380 of the central hollow hub 36 toward the outer wall 161 of the base 16. Each radial wall 34 extends along the mounting axis M from the lower inner shell 3 of the base 16 toward the upper inner shell 149.

The central hollow hub 36 comprises a multiplicity of radial through slits 500 which allow the balm 2 in heated semi-fluid phase to flow in a controlled manner without damaging the cosmetic container 1 and preventing the balm 2 from being contaminated or becoming cloudy. Each radial through slit 500 of the multiplicity of radial through slits 500 is arranged between two adjacent radial walls 34 of the multiplicity of radial walls 34. Each radial through slit 500 is adapted to allow the passage of the balm 2 in heated semi-fluid phase during the filling step between the inner cavity 360 of the central hollow hub 36 and one of the sectors of space 18 of the lower inner shell 3 of the base 16.

Advantageously, at least one radial through slit 500 is arranged between two adjacent radial walls 34 of the multiplicity of radial walls 34 so that each sector of space 18 of the lower inner shell 3 of the base 16 is supplied with balm 2 in heated semi-fluid phase during the filling step by the at least one radial through slit 500.

Advantageously, each radial through slit 500 is arranged on a lower portion 363 of the central hollow hub 36 to even better control the flow of balm 2 in heated semi-fluid phase inside the cosmetic container 1.

Each radial wall 34 of the multiplicity of radial walls 34 comprises an upper portion 349 comprising at least one upper overflow through slit 340. Each upper overflow through slit 340 is adapted to allow the passage of the balm 2 in heated semi-fluid phase during the filling step between at least two of the sectors of space 18 of the lower inner shell 3 of the base 16.

At least one upper overflow through slit 340 is arranged at the upper portion 349 of the radial wall 34 in proximity of the central hollow hub 36. The at least one upper overflow through slit 340 is adapted to allow the passage of the balm 2 in heated semi-fluid phase during the filling step between the inner cavity 360 of the central hollow hub 36 and at least two of the sectors of space 18 of the lower inner shell 3 of the base 16. As shown, in particular in FIGS. 7, 9, and 12, a multiplicity of upper overflow through slits 340 are arranged on the upper portion 349 of each radial wall 34 in proximity of the central hollow hub 36 so as to favor the passage of the balm 2 in heated semi-fluid phase between the sectors of space 18 and the inner cavity 360 of the central hollow hub 36.

As shown in particular in FIGS. 1, 5, 6, 12, 17 and 18, a lower plug 160 closes, from the outside, the through opening 23 of the base 16.

With regard to the filling step of the balm 2 in heated semi-fluid phase into the cosmetic container 1, the cosmetic container 1 is flipped over, the upper inner shell 149 is mounted on the base 16 and the through opening 23 faces upwards to facilitate the introduction of the balm 2 in heated semi-fluid phase. The balm 2 in heated semi-fluid phase is inserted inside the through opening 23 of the base and advantageously flows in a controlled and constant manner inside the inner cavity 360 of the central hollow hub 36 without becoming cloudy, without being contaminated and without damaging the cosmetic container 1. The balm 2 in heated semi-fluid phase flows in a controlled and constant manner from the inner cavity 360 of the central hollow hub 36 to the sectors of space 18 of the lower inner shell 3 by means of the radial through slits 500 filling them gradually, in a controlled manner. The balm 2 in heated semi-fluid phase flows inside the base 16 in the direction of the upper inner shell 149 in a controlled manner. Upper overflow through slits 340 of the radial walls 34 allow the passage of the balm 2 in heated semi-fluid phase between the sectors of space 18 and the inner cavity 360 even better distributing the balm 2 inside of the cosmetic container 1 and allowing it to flow in a controlled manner. The upper inner shell 149 is filled with the balm 2 in heated semi-fluid phase, up to an upper portion of the support frame 30 of the base 16. The lower plug 160 closes the through opening 23 of the base 16.

Advantageously, the base 16 is already mounted, facilitating the mounting operations of the cosmetic container 1, thus reducing the mounting operations. It is only necessary to close the through opening 23 of the base 16 with the lower plug 160 once the filling step has ended.

Advantageously, the balm 2 in heated semi-fluid phase flows in the cosmetic container 1 in a controlled manner without damaging it, and the balm 2 is not contaminated nor does it become cloudy.

The shape of the base 16, which includes the central hollow hub 36, the multiplicity of radial through slits 500, the radial walls 34 partitioning the lower inner shell 3 into sectors of space 18 advantageously allow the balm 2 in heated semi-fluid phase to flow in a controlled manner and with a constant flow toward the upper inner shell 149, without damaging the cosmetic container 1, without making the balm 2 cloudy and without contaminating the balm 2.

The upper overflow through slits 349 allow easier identification of when the cosmetic container 1 is filled up with the balm 2 in heated semi-fluid phase, advantageously allowing better leveling of the balm 2 without lumps or protrusions, so that once the balm 2 is in solidified phase, it can be better and more securely supported by the supporting frame 30 of the base 16.

Once the balm 2 is in solidified phase, the support frame 30 supports it.

As for the application of the balm 2 in solidified phase to the lips of a person, it is sufficient to remove the cap 14 on which the central cap 140 is mounted, by uncovering the balm 2 with the cosmetic container 1 open.

Alternatively, the cap 14 can have an outer shape of any kind. The upper inner shell 149 has a complementary shape with respect to an outer surface of the lip balm 2 in solidified phase.

Alternatively, the central cap 140 can have an outer shape of any kind. The upper inner shell 149 has a complementary shape with respect to an outer surface of the lip balm 2 in solidified phase.

Alternatively, the central cap 140 is not provided. In the alternative, the cap 14 comprises the upper inner shell 19, which has a complementary shape to an outer surface of the lip balm 2 in solidified phase.

Alternatively, the central cap 140 is separably mountable with the base 16 along the mounting axis M. The cap 14 is, in turn, separably mountable to the base 16, but not with the central cap 140. In the alternative, the central cap 140 comprises the upper inner shell 149. In the alternative, the central cap 140 comprises an inner threaded portion 15. The base 16 comprises the outer threaded portion 17. The inner threaded portion 15 of the central cap 140 is adapted to be screwed onto the outer threaded portion 17 of the base 16.

Alternatively, the lower inner shell 3 of the base 16 is of a shape comprised in a list comprising a lower inner shell 3 of curvilinear shape, of convex shape, star-shaped, cone-shaped with surfaces protruding toward the central hollow hub 36.

Alternatively, the upper inner shell 19, 149 has a complementary shape with respect to an outer surface of the lip balm 2 in solidified phase, which may be of any shape adapted to allow the application of the balm 2 on the lips.

Alternatively, more than one radial through slit 500 is arranged between two adjacent radial walls 34 of the multiplicity of radial walls 34 so that each sector of space 18 of the lower inner shell 3 of the base 16 is supplied with balm 2 in heated semi-fluid phase during the filling step by the at least one radial through slit 500.

Alternatively, it is possible to provide that at least one radial through slit 500 is arranged on an upper portion of the central hollow hub 36 or still on a portion different from the lower portion 363 of the central hollow hub 36. It is possible to provide that the radial through slits 500 are arranged along the entire central hollow hub 36.

Alternatively, it is provided that each radial wall 34 of the multiplicity of radial walls 34 comprises an upper portion 349 comprising a multiplicity of upper overflow through slits 340.

Alternatively, it is possible to provide that no upper overflow through slits 340 be there.

Advantageously, the cosmetic container 1 for applying a lip balm 2 according to the present invention is simplified, much easier and quicker to mount, allows for being filled with balm 2 in heated semi-fluid phase in a safer and quicker manner, without damaging the cosmetic container 1 and without contaminating the balm 2.

The invention claimed is:

1. A cosmetic container for applying a lip balm, the cosmetic container comprising:

a cap;

an upper inner shell; and a base, said cap and said base being separably mountable to each other along a mounting axis (M) to form the cosmetic container, said base including a support frame for supporting the lip balm in solidified phase, wherein said upper inner shell is provided between said cap and said base, said base comprises a lower inner shell, a through opening is provided at a bottom of said base, the through opening is adapted to allow the passage of the balm in heated semi-fluid phase during a filling step of the balm in heated semi-fluid phase into the cosmetic container with the cosmetic container being completely assembled and in an overturned position, and a lower plug is provided to close the through opening of the base before and after the filling step, wherein said support frame is one piece with said lower inner shell, an inner central portion of said lower inner shell is an inner bottom of said base and opens into said through opening, said support frame of said base comprises a central hollow hub extending along the mounting axis (M) from the inner central portion of said lower inner shell, said central hollow hub comprises an inner cavity opening at a bottom thereof into said through opening, said central hollow hub comprises an outer surface facing said lower inner shell of said base, said central hollow hub comprises a multiplicity of radial through slits, said support frame of said base comprises a multiplicity of radial walls partitioning the inside of said lower inner shell into sectors of space of said lower inner shell, each radial wall of said multiplicity of radial walls extends along the mounting axis (M) from said lower inner shell of said base, each radial through slit of said multiplicity of radial through slits is disposed between two adjacent radial walls of said multiplicity of radial walls to allow the passage of the balm in heated semi-fluid phase during the filling step from the inner cavity of said central hollow hub to one of the sectors of space of said lower inner shell of said base, wherein each radial wall of said multiplicity of radial walls radially extends from the outer surface of said central hollow hub toward an outer wall of said base, and wherein each radial wall of said multiplicity of radial walls comprises an upper portion comprising at least one upper overflow through slit, each upper overflow through slit is adapted to allow the passage of the balm in heated semi-fluid phase during the filling step across at least two of the sectors of space of said lower inner shell of said base.

2. The cosmetic container according to the claim 1, wherein more than one radial through slit of said multiplicity of radial through slits is disposed between two adjacent radial walls of said multiplicity of radial walls.

3. The cosmetic container according to claim 1, wherein each radial through slit of said multiplicity of radial through slits is arranged at a lower portion of the central hollow hub.

4. The cosmetic container according to the claim 1, wherein at least one of said upper overflow through slits is arranged at the upper portion of said corresponding radial wall in proximity of said central hollow hub, said at least one upper overflow through slit is adapted to allow the passage of the balm in heated semi-fluid phase during the filling step from the inner cavity of said central hollow hub to at least two of the sectors of space of said lower inner shell of said base.

5. The cosmetic container according to claim 1, wherein said lower inner shell comprises a border in contact with the outer wall of said base and said inner central portion which is a bottom of said lower inner shell, the border of said lower inner shell is arranged at a higher level with respect to the inner central portion of said lower inner shell, and the level is measured along the mounting axis (M).

6. The cosmetic container according to claim 1, wherein said lower inner shell is of concave shape.

7. The cosmetic container according to claim 1, wherein said cap comprises said upper inner shell.

8. The cosmetic container according to claim 1, further comprising a central cap comprising said upper inner shell, said central cap being separably mountable with said cap along the mounting axis (M).

9. The cosmetic container according to the claim 8, wherein said central cap includes interlocking elements which interlock with interlocking elements of an inner surface of said cap.

10. The cosmetic container according to claim 1, further comprising a central cap comprising said upper inner shell, said central cap being separably mountable with said base along the mounting axis (M).

11. The cosmetic container according to claim 1, wherein said upper inner shell is of curvilinear shape.

12. The cosmetic container according to claim 1, wherein the cap is of curvilinear shape.

* * * * *